US007524042B2

(12) United States Patent
Weksler et al.

(10) Patent No.: US 7,524,042 B2
(45) Date of Patent: Apr. 28, 2009

(54) INK JET PRINTERS AND METHODS

(75) Inventors: Meir Weksler, Mazkeret Batia (IL); Yehoshua Sheinman, RaAnana (IL); Ilan Ben-Shahar, Nes Ziona (IL)

(73) Assignee: Jemtex Ink Jet Printing Ltd., Lod (IL)

( * ) Notice: Subject to any disclaimer, the term of this patent is extended or adjusted under 35 U.S.C. 154(b) by 207 days.

(21) Appl. No.: 11/509,658

(22) Filed: Aug. 25, 2006

(65) Prior Publication Data

US 2006/0284942 A1 Dec. 21, 2006

Related U.S. Application Data

(62) Division of application No. 10/475,523, filed as application No. PCT/IL02/00346 on May 2, 2002, now Pat. No. 7,104,634.

(60) Provisional application No. 60/288,097, filed on May 3, 2001.

(51) Int. Cl.
*B41J 2/125* (2006.01)

(52) U.S. Cl. ..... 347/81

(58) Field of Classification Search ..... None
See application file for complete search history.

(56) References Cited

U.S. PATENT DOCUMENTS 4,148,718 A 4/1979 Fulwyler
4,350,986 A 9/1982 Yamada
4,491,852 A 1/1985 Jinnai (Continued)

FOREIGN PATENT DOCUMENTS

GB 1124163 8/1968

(Continued)

OTHER PUBLICATIONS

N.N. Nguyen et al.Determining Ind Drop Velocity in an Ink Jet Printer by Stroboscopic Method, 1979, IBM Technical Disclosure Bulletin, vol. 211., No. 11., pp. 4593-4594.*

(Continued)

*Primary Examiner*—K. Feggins

(57) ABSTRACT

A method and apparatus for printing a desired pattern on a substrate by discharging continuous streams of liquid ink drops from nozzles towards the substrate, and selectively charging the liquid ink drops with multi-level charges deflecting them different amounts. Some of the liquid ink drops are thus directed to different locations on the substrate for printing the desired pattern thereon, while other liquid ink drops not to be printed are intercepted by a gutter before reaching the substrate. At least some of the liquid ink drops to be printed being either uncharged or charged with a multi-level charge of one polarity, while all the liquid ink drops not to be printed are charged with a charge of the opposite polarity. Each stream of ink drops discharged from a nozzle is illuminated with stroboscopic light at the same frequency as the drop formation, and the illuminated stream is optically sensed on the fly for determining various conditions, including ink velocity, X-axis offset and Y-axis offset.

23 Claims, 6 Drawing Sheets

U.S. PATENT DOCUMENTS

| | | | | | |
|---|---|---|---|---|---|
| 4,688,049 | A | | 8/1987 | Doyle et al. | |
| 5,410,342 | A | | 4/1995 | Lecheheb et al. | |
| 5,455,614 | A | | 10/1995 | Rhodes | |
| 5,821,963 | A | | 10/1998 | Sutera et al. | |
| 5,975,682 | A | | 11/1999 | Lee et al. | |
| 5,988,480 | A | * | 11/1999 | Farnworth | 228/33 |
| 6,003,980 | A | * | 12/1999 | Sheinman et al. | 347/78 |
| 6,224,180 | B1 | | 5/2001 | Pham-Van-Diep et al. | |
| 2004/0130585 | A1 | | 7/2004 | Weksler et al. | |

FOREIGN PATENT DOCUMENTS

| | | |
|---|---|---|
| WO | WO 02/090119 | 11/2002 |

OTHER PUBLICATIONS

Nguyen et al. "Determining Ink Drop Velocity in An Ink Jet Printer by Stroboscopic Method", IBM Technical Disclosure Bulletin, 21(11): 4593-4594, 1979. Abstract.

* cited by examiner

INK JET PRINTERS AND METHODS

RELATED APPLICATIONS

This Application is a U.S. Divisional Application of U.S. patent application Ser. No. 10/475,523, filed on Oct. 29, 2003, which is a U.S. National Phase of PCT Application No. PCT/IL02/00346, filed on May 2, 2002, which claims the benefit of U.S. Provisional Patent Application No. 60/288,097, filed on May 3, 2001. The contents of the above Applications are incorporated herein by reference.

FIELD AND BACKGROUND OF THE INVENTION

The present invention relates to ink jet printers and methods of printing by ink jets. The present invention is particularly useful in the apparatus and methods described in our prior U.S. Pat. Nos. 5,969,733, 6,003,980 and 6,106,107, the contents of which are hereby incorporated by reference. The invention is therefore described below with regard to such apparatus and methods, but it will be appreciated that the invention could also be used in other apparatus and methods.

Ink jet printers are based on forming drops of liquid ink and selectively depositing the ink drops on a substrate. The known ink jet printers generally fall into two categories: drop-on-demand printers, and continuous-jet printers.

Drop-on-demand printers selectively form and deposit the ink jet drops on the substrate as and when demanded by a control signal from an external data source. Such systems typically use nozzles having relatively large openings, ranging from 30 to 100 μm.

Continuous-jet printers, on the other hand, are stimulated by a perturbation device, such as a piezoelectric transducer, to form the ink drops from a continuous ink jet filament at a rate determined by the perturbation device. The drops are selectively charged and deflected to direct them onto the substrate according to the desired pattern to be printed.

Continuous-jet printers are divided into two types of systems: binary, and multi-level. In binary systems, the drops are either charged or uncharged and, accordingly, either reach or do not reach the substrate at a single predetermined position. In multi-level systems, the drops can receive a large number of charge levels and, accordingly, can generate a large number of print positions.

The process of drop formation depends on many factors associated with the ink rhelogy (e.g. viscosity, surface tension), the ink flow conditions (e.g. jet diameter, jet velocity), and the characteristics of the perturbation (e.g. frequency and amplitude of the excitation). Typically, drop formation is a fast process, occurring in the time frame of a few microseconds. However, because of possible variations in one or more of the several factors determining the drop formations, variations are possible in the exact timing of the drop break-off. These timing variations can cause incorrect charging of drops if the electrical field responsible for drop charging is turned-on, turned-off, or changed to a new level, during the drop break-off itself. Therefore it is necessary to keep the data pulse precisely in-phase relative to the drop break-off timing, in order to obtain accurate drop charging and printing.

Another type of commonly-occurring printing error is incorrect velocity of the ink drops such that the ink drop is not deflected to its proper position on the substrate. Drop velocity (or jet speed) errors may be produced by many different factors, such as those associated with the ink rhelogy and/or the ink flow conditions. Such errors may be corrected by changing the drop charging voltage applied to the ink drops since the amount of deflection experienced by the ink drops before impinging the substrate depends on the drop velocity, the voltage applied to the deflector plates electric field, and the drop charge.

A still further problem in ink jet printing is the formation of satellites in the stream of drops. Satellites are characterized by volumes which are much smaller (typically by more than one order of magnitude) than the basic drop volume, i.e. the volume within the drop desired to be printed. In the usual capacitively charged configurations, satellites carry a charge similar to the charge carried by the basic drop. The acceleration experienced by charged drops in an electrical field is inversely proportional to their masses. Since the mass of the satellite is much smaller than the mass of the basic drop, satellites will experience a much stronger acceleration inside the deflection field, and may therefore impinge against the deflecting plates. This could result in an electrical breakdown condition or other malfunction of the printer.

The above-cited U.S. Pat. No. 6,003,980 discloses a method and apparatus for sensing improper operation of an ink jet printer by printing test marks on a test strip, and then analyzing the printed test marks. However, such a technique is not always practical or convenient particularly with respect to ink jet printers including a large number of nozzles. In addition, relying on an analysis of printed marks on a substrate for sensing improper operation of an ink jet printer may suffer from lack of consistency because of inconsistencies in the substrates themselves.

BRIEF SUMMARY OF THE PRESENT INVENTION

An object of the present invention is to provide a method of ink jet printing, and also an ink jet printing apparatus, having advantages in one or more of the above respects.

According to one aspect of the present invention, there is provided a method of printing a desired pattern on a substrate, comprising: discharging a continuous stream of liquid ink drops from a nozzle along the nozzle axis towards the substrate; selectively charging the liquid ink drops with multi-level charges for selectively deflecting them different amounts with respect to the nozzle axis to thereby direct some of the liquid ink drops to different locations on the substrate for printing the desired pattern thereon, while other liquid ink drops not to be printed are intercepted by a gutter before reaching the substrate; at least some of the liquid ink drops to be printed being either uncharged or charged with a multi-level charge of one polarity, while all the liquid ink drops not to be printed are charged with a charge of the opposite polarity; illuminating the stream of liquid ink drops discharged from the nozzle with stroboscopic light at the frequency of the drop formation; optically sensing and displaying an image of the illuminated stream of liquid drops and the distance between the first and last drops in the image; and calculating the velocity of the liquid drops according to the image displayed.

As will be described more particularly below, such a feature enables the uncharged (free-fall) drops to be used for printing and also for calibration purposes as will be described more particularly below. Another advantage of this feature is that it enables a relatively wide drop "fan" to be created without increasing the charges on the drops having the longest deflection since the relatively low charged drops are printing drops, and not non-printing drops to be directed to the gutter.

In one described preferred embodiment, each of the liquid ink drops to be printed is either uncharged or charged with a multi-level charge of the one polarity; and in a second described embodiment, each of the liquid ink drops to be printed is also charged with a multi-level charge of the opposite polarity but of a lower level than that of the liquid ink drops not to be printed.

According to a further embodiment, the liquid ink drops are selectively deflected by deflecting plates which diverge in the direction towards the substrate. This feature also enables the "fan" to be increased, without increasing the voltage level of the charges to be applied to the drops.

According to another aspect of the invention, there is provided a method of printing a desired pattern on a substrate, comprising: discharging a continuous stream of liquid ink drops from a nozzle along the nozzle axis towards the substrate; and selectively charging the liquid ink drops with multi-level charges for selectively deflecting them different amounts with respect to the nozzle axis to thereby direct some of the liquid ink drops to different locations on the substrate for printing the desired pattern thereon, while other liquid ink drops not to be printed are intercepted by a gutter before reaching the substrate; the stream of liquid ink drops discharged from the nozzle being illuminated with stroboscopic light at the frequency of the drop formation; and the illuminated stream of liquid ink drops being optically sensed on the fly for determining the ink velocity of the stream of drops.

According to further features in the described preferred embodiments, the illuminated stream of drops is sensed by a camera having an imaging lens. Errors in the ink velocity may be determined by comparing the optically-sensed stream of drops with a reference and may be compensated for by modifying the charges applied to the drops.

According to a still further aspect of the present invention, there is provided a method of printing a desired pattern on a substrate, comprising: discharging a continuous stream of liquid ink drops from a nozzle along the nozzle axis towards the substrate; and selectively charging the liquid ink drops with multi-level charges for selectively deflecting them different amounts with respect to the nozzle axis to thereby direct some of the liquid ink drops to different locations on the substrate for printing the desired pattern thereon, while other liquid ink drops not to be printed are intercepted by a gutter before reaching the substrate; wherein two streams of ink drops are produced from the nozzle by charging pulses of two charging levels, the two streams of ink drops being illuminated by stroboscopic light at the frequency of the drop formation and being optically sensed on the fly by an imaging system for determining charge phasing errors between the respective charging pulses and the physical drop formation timing in the stream exiting from the nozzle.

According to a still further aspect of the invention, there is provided a method of printing a desired pattern on a substrate, comprising: forming a continuous stream of liquid ink drops by an acoustical excitation device in a nozzle; discharging the stream of drops from the nozzle along the nozzle axis towards the substrate; and selectively charging the liquid ink drops with multi-level charges for selectively deflecting them different amounts with respect to the nozzle axis to thereby direct some of the liquid ink drops to different locations on the substrate for printing the desired pattern thereon, while other liquid ink drops not to be printed are intercepted by a gutter before reaching the substrate; wherein the forming of the liquid ink drops is monitored on the fly by illuminating the stream of drops with stroboscopic light at the frequency of the drop formation, an image of a plurality of liquid drops in the illuminated streams is optically sensed and displayed; the distance between the first and last drops in the displayed image is observed to determine the velocity of the individual drops in a manner which tends to cancel noise and drop break-off is controlled by controlling the acoustical excitation device to avoid satellite formations in the displayed image of drops.

According to a still further aspect of the invention, there is provided a method of printing a desired pattern on a substrate, comprising: discharging a plurality of continuous streams of liquid ink drops from a plurality of nozzles having nozzle axes in linear alignment along a printing axis; selectively charging the liquid ink drops by input data, according to the pattern desired to be printed, with multi-level charges for selectively deflecting the liquid ink drops given amounts with respect to their respective nozzle axes to thereby direct some of the liquid ink drops to different locations on the substrate for printing the desired pattern thereon, while other liquid ink drops not to be printed are intercepted by a gutter before reaching the substrate; utilizing at least two sensor devices for sensing the liquid ink drops of each of the streams, the sensor devices having sensor axes at a predetermined angle to each other; and processing outputs of the sensor devices, including the predetermined angle of their sensor axes, to compute deviations of the respective stream of ink drops from the respective nozzle axis (a) in the direction perpendicular to the printing axis (X-axis offset), and (b) in the direction along the printing axis (Y-axis offset).

According to further features in the described preferred embodiment, the sensor devices are optical sensors, preferably cameras having an imaging lens and the streams of ink drops are illuminated with stroboscopic light at the same frequency as the drop formation.

According to further features in the described preferred embodiments, the computed X-axis offset for a particular nozzle is corrected by adjusting the charging voltages for the respective nozzle; and the computed Y-axis offset for a particular nozzle is corrected by adjusting the timing of the input data to the respective nozzle.

According to a further aspect of the invention, there is provided printing apparatus for printing a desired pattern on a substrate, comprising: a nozzle for forming and discharging a continuous stream of liquid ink drops along the nozzle axis towards the substrate; charging plates for selectively charging the liquid ink drops with multi-level charges; deflecting plates for selectively deflecting the liquid ink drops in different amounts with respect to the nozzle axis to thereby direct some of the liquid ink drops to different locations on the substrate for printing thereon the desired pattern; a gutter for intercepting, before reaching the substrate, the liquid ink drops not to be printed; and a control system for controlling the charging plates and the deflecting plates; the control system controlling the charging plates such that at least some of the liquid ink drops to be printed are either uncharged or charged with a multi-level charge of one polarity, while all the liquid ink drops not to be printed are charged with a charge of the opposite polarity.

According to a still further aspect of the invention, there is provided printing apparatus for printing a desired pattern on a substrate, comprising: a plurality of nozzles for forming and discharging continuous streams of liquid ink drops along the respective nozzle axis towards the substrate, the nozzles having nozzle axes in linear alignment along a printing axis; charging plates for each nozzle for selectively charging the liquid ink drops of the respective nozzle with input data according to the pattern desired to be printed; deflecting plates for each nozzle for selectively deflecting the liquid ink drops different amounts with respect to the respective nozzle axis for printing on a substrate the desired pattern; a gutter for intercepting, before reaching the substrate, the liquid ink drops not to be printed; at least two sensor devices for sensing the liquid ink drops in each of the continuous streams, the sensor devices having sensor axes at a predetermined angle to each other; and a control system for controlling the charging plates and the deflecting plates, the control system processing outputs from the sensor devices; computing deviations of the respective stream of ink drops from the respective nozzle axis (a) in the direction perpendicular to the printing axis (X-axis offset), and (b) in the direction along the printing axis (Y-axis offset); and correcting the pattern printed by the respective nozzle in accordance with the computed deviations.

Further features and advantages of the invention will be apparent from the description below.

DESCRIPTION OF PREFERRED EMBODIMENTS

The invention is herein described, by way of example only, with reference to the accompanied drawings, wherein.

Figure 4:
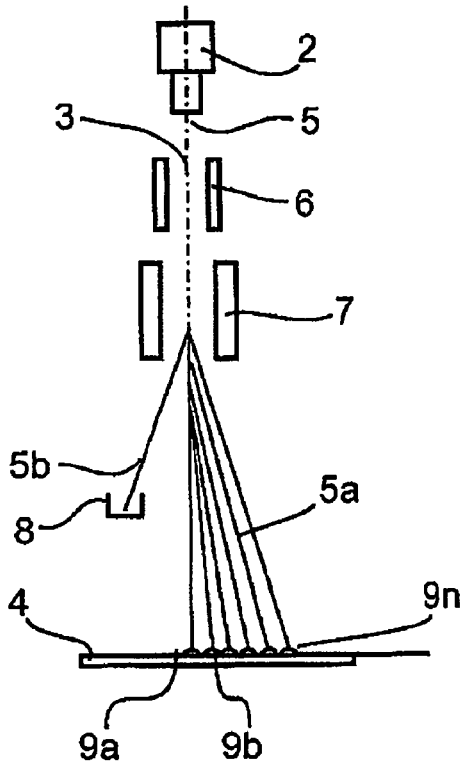
FIG. 4 is a diagram illustrating one form of ink jet printer utilizing multi-level charging constructed in accordance with the present invention.
Figure 5:
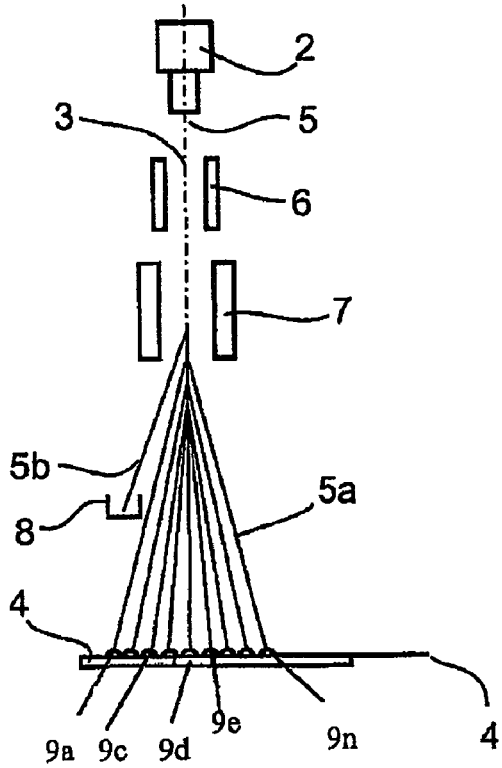
FIG. 5 is a diagram illustrating another form of ink jet printer utilizing multi-level charging constructed in accordance with the present invention.
Figure 6:
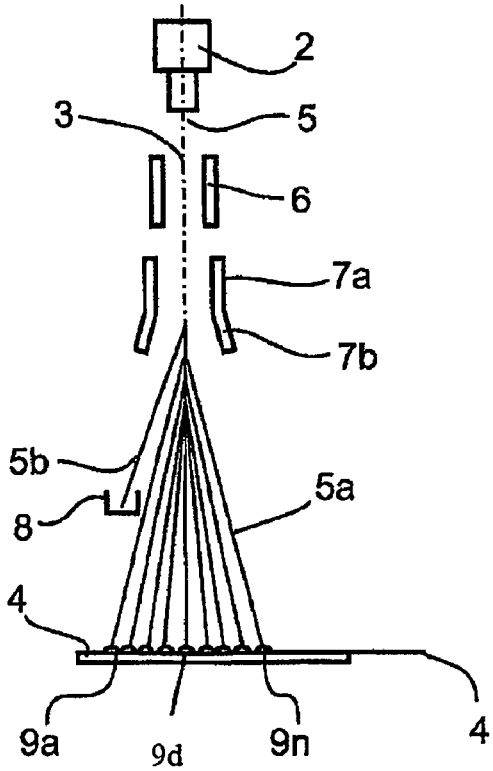
Figure 7:
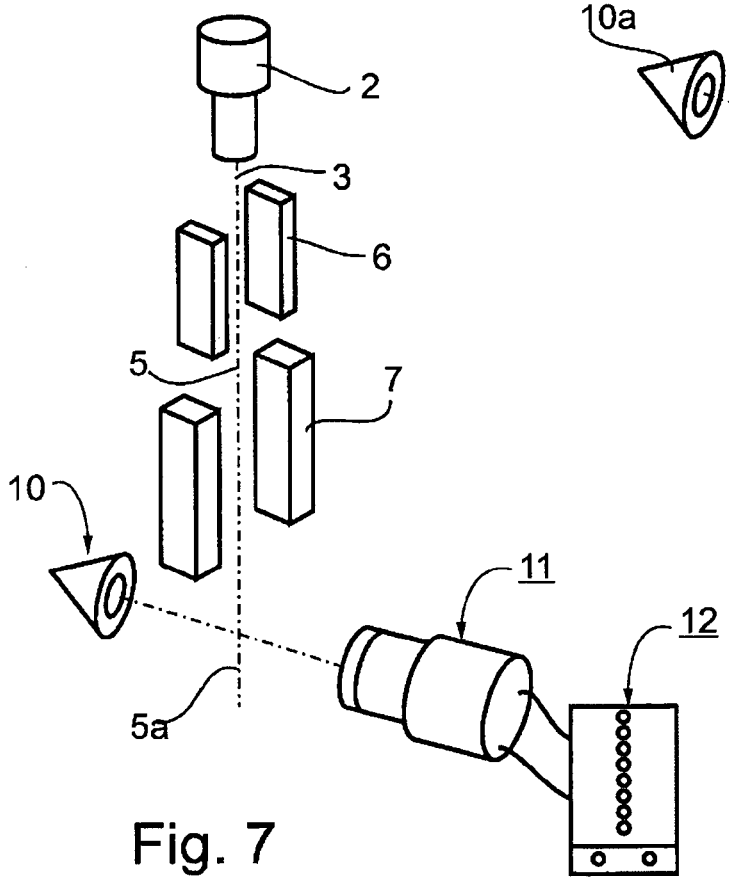
Figure 7A:
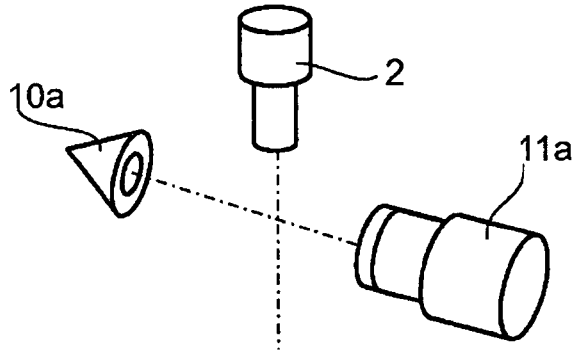
Figure 12:
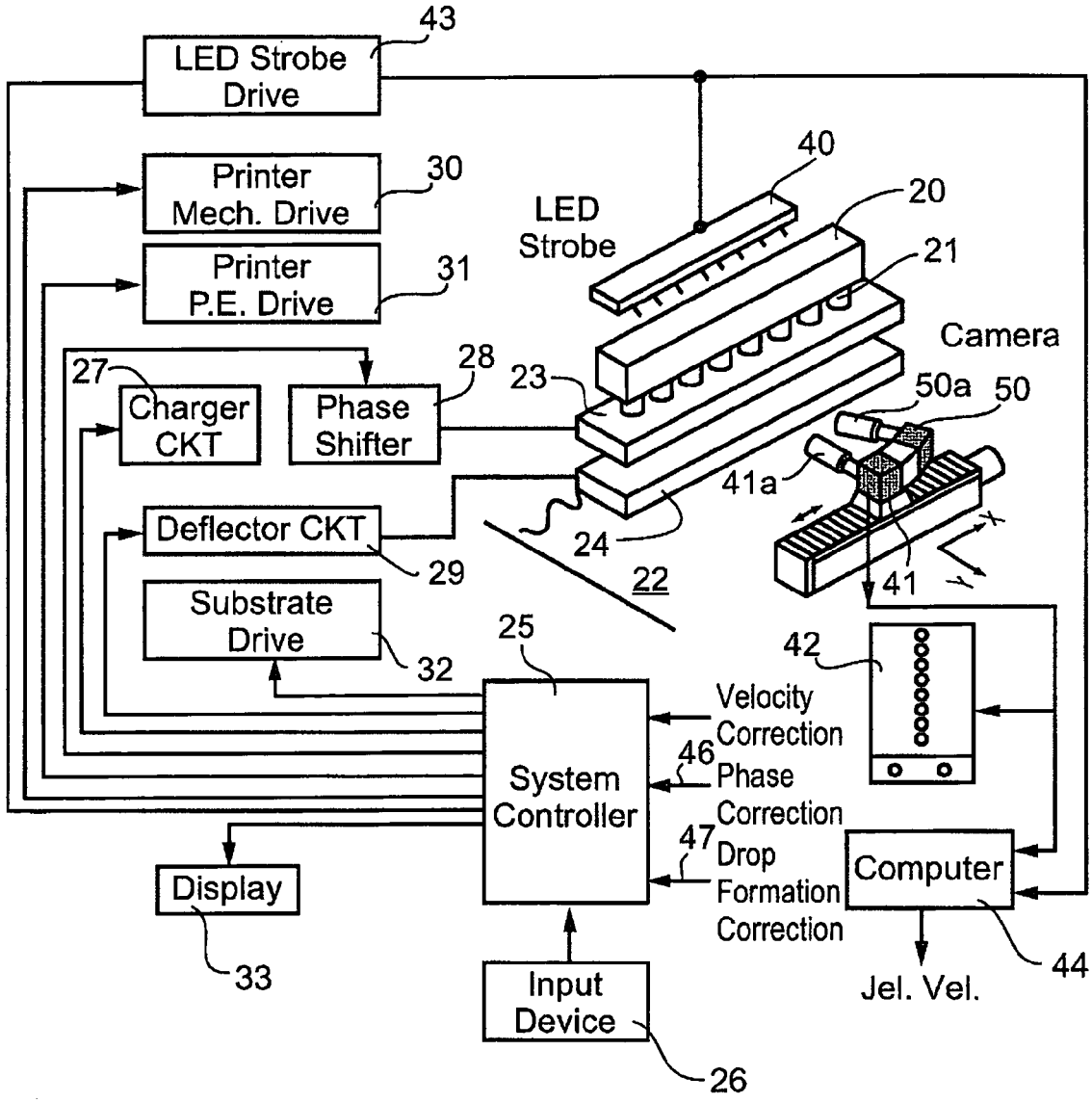
Figure 13:
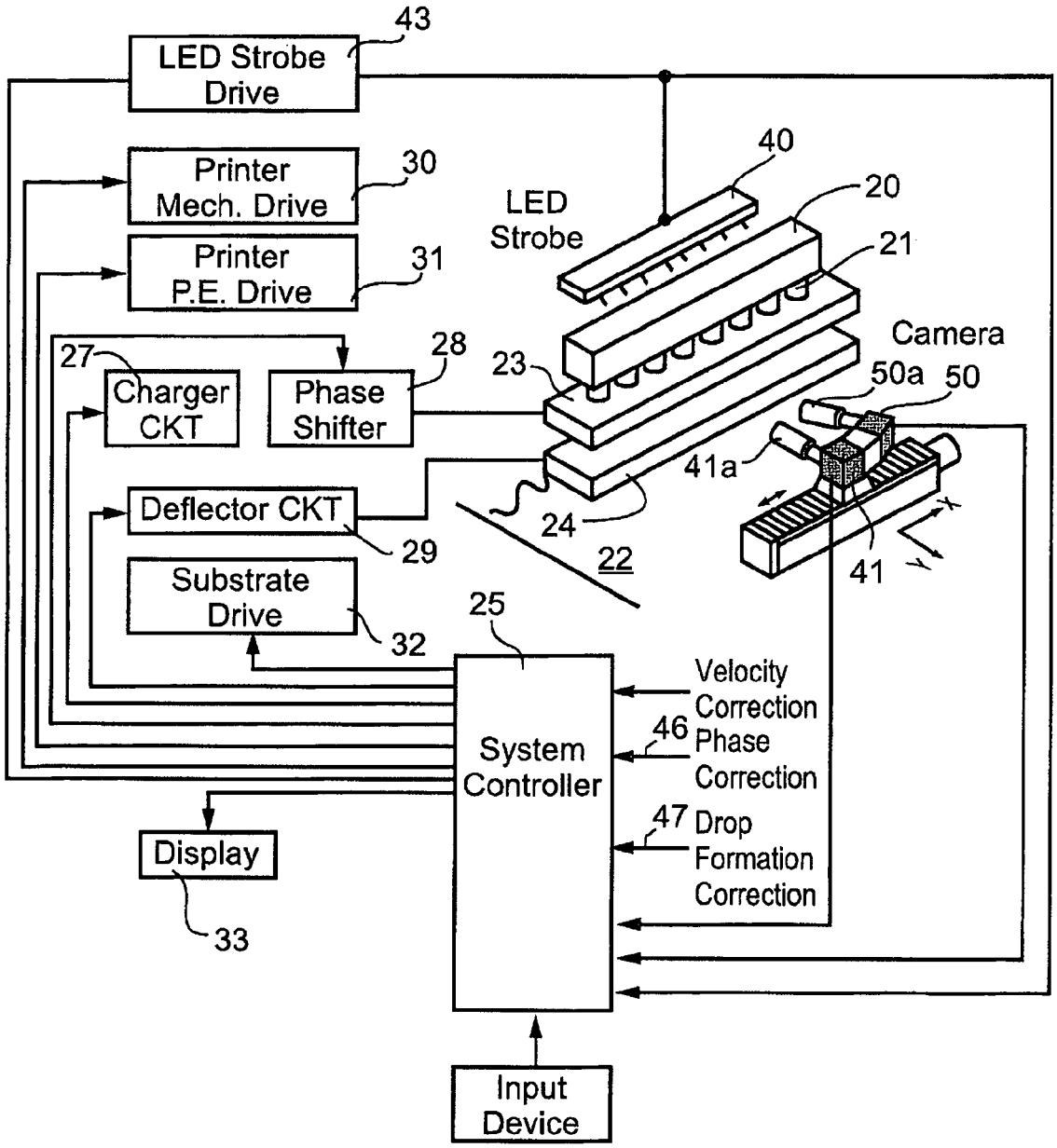
Figure 14:
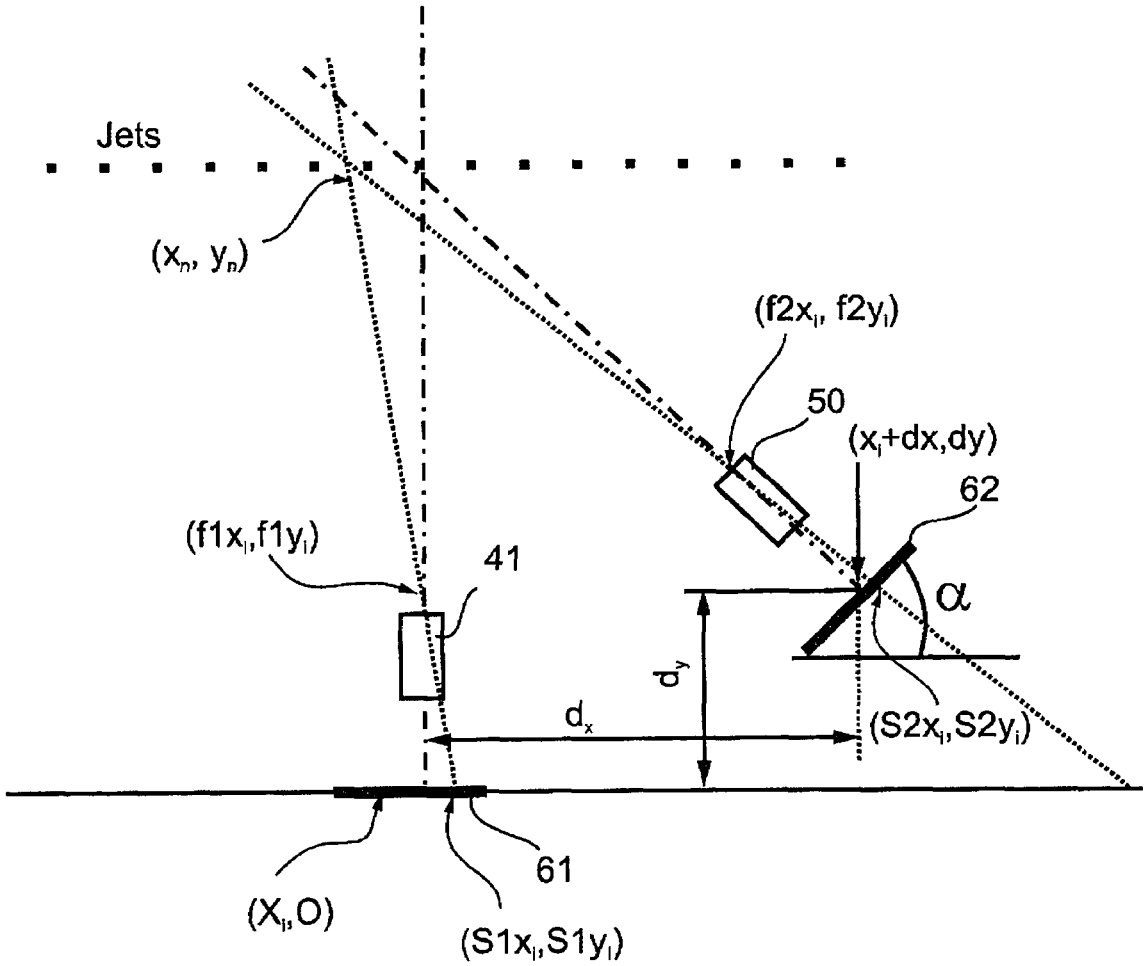

FIG. 6 diagrammatically illustrates a modification in the construction of the ink jet printer of either FIGS. 4 or 5;

FIG. 7 diagrammatically illustrates an ink jet printer constructed in accordance with the present invention to facilitate calibration and correction of errors in the ink drop velocity and/or in the phasing between the charging pulses and the physical separation of the drop;

FIG. 7*a* diagrammatically illustrates a modification in the ink jet printer of FIG. 7 for observing and controlling the shape of the ink drops to avoid the formation of satellites;

FIGS. 8-11 are diagrams helpful in explaining the operation of the apparatus illustrated in FIG. 7;

FIG. 12 is a block diagram more particularly illustrating one form of apparatus constructed in accordance with the present invention;

FIG. 13 is a block diagram illustrating apparatus similar to that of FIG. 12, but including further means for measuring, and correcting for, both X-axis offset and Y-axis offset in a particular nozzle; and FIG. 14 is a diagram illustrating the manner in which the X-axis offsets and Y-axis offsets are computed in the apparatus of FIG. 13.

It is to be understood that the foregoing drawings, and the description below, are provided primarily for purposes of facilitating understanding the conceptual aspects of the invention and various possible embodiments thereof, including what is presently considered to be a preferred embodiment. In the interest of clarity and brevity, no attempt was made to provide more details than necessary to enable one skilled in the art, using routine skill and design, to understand and practice the described invention. It is to be further understood that the embodiments described are for purposes of example only, and that the invention is capable of being embodied in other forms and applications than described herein.

BRIEF DESCRIPTION OF THE PRIOR ART (FIGS. 1-3)

Figure 1:
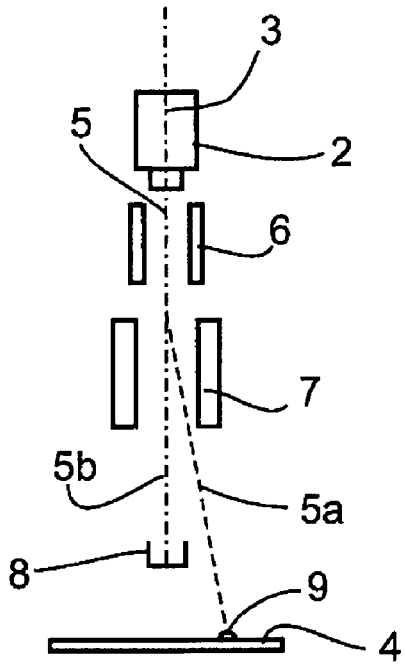
Fig. 1(Prior Art)
FIG. 1 is a diagram illustrating a simplified ink jet printer according to the prior art.

FIG. 1 illustrates a simplified construction of a continuous-jet printer according to the prior art. The illustrated printer includes a nozzle 2 containing a reservoir of liquid ink directing the liquid ink in the form of a continuous jet along the nozzle axis 3 towards a substrate 4 for deposition thereon according to the desired pattern to be printed. Nozzle 2 includes a perturbator, such as a piezoelectric transducer, which converts the jet of liquid ink into a continuous stream of liquid ink drops 5 initially directed along the nozzle axis 3 towards the substrate 4, but selectively deflected according to the desired pattern to be printed on the substrate. The selective deflection of the liquid ink drops 5 is effected first by a pair of charging plates 6 straddling the nozzle axis 3, and then by a pair of deflecting plates 7 also straddling the nozzle axis. The charging plates 6 selectively charge the drops 5 at the instant of drop break-off from the jet filament, and the deflecting plates 7 deflect the charged drops with respect to the nozzle axis 3. A gutter or catcher 8 between the deflecting plates 7 and the substrate 4 catches those liquid ink drops which are not to be deposited on the substrate 4. The so-caught drops are circulated back to the reservoir of the respective nozzle 2.

The arrangement illustrated in FIG. 1 is a bi-level deflection arrangement in which the liquid ink drops 5 are either charged or not charged, and in which the gutter 8 is aligned with the nozzle axis 3 so as to receive the uncharged (free-fall) drops. Thus, as shown in FIG. 1, the charged drops 5*a* are deflected so as to be deposited as a printed dot 9 on the substrate 4; whereas the uncharged (free-fall) drops 5*b* are caught by the gutter 8 and therefore do not reach the substrate 4.

Figure 2:
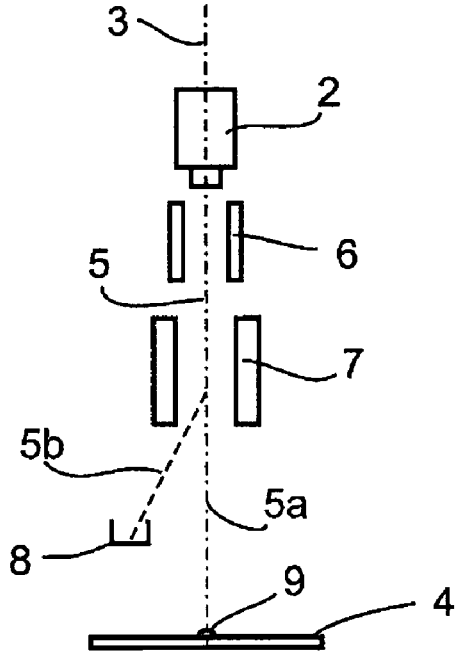
Fig. 2(Prior Art)
FIG. 2 is a diagram illustrating a simplified prior art printer utilizing bi-level charging of the drops.

FIG. 2 illustrates a bi-level deflection printer of basically the same construction as described above with respect to FIG. 1, except that the substrate 4 receives the uncharged drops 5*a* to be printed, whereas the gutter 8 receives the charged drops 5*b* not to be printed. Thus, as shown in FIG. 2 (which uses the same reference numerals to identify corresponding parts as shown in FIG. 1), it will be seen that the gutter 8 is located laterally of the nozzle axis 3, so as to receive the charged liquid ink drops 5*b*, whereas the uncharged (free-fall) drops 5*a* are deposited on the substrate 4 to produce the printed dots 9.

Figure 3:
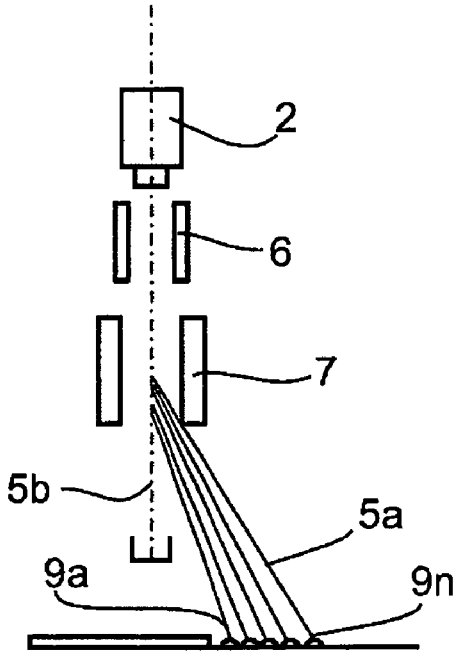
Fig. 3(Prior Art)
FIG. 3 is a diagram illustrating a simplified prior art printer utilizing multi-level charging of the drops.

FIG. 3 illustrates a prior art ink jet printer of a similar construction as in FIG. 1, except that it utilizes a multi-level deflection arrangement, rather than a bi-level deflection arrangement. The basic difference in FIG. 3 (which also identifies the corresponding parts of FIG. 1 with the same reference numerals to facilitate understanding) is that, instead of utilizing the charging plates 6 for applying only two levels of charges to the liquid ink drops (charged or uncharged), in FIG. 3 the charging plates 6 apply any one of a plurality of charges to the drops in order to selectively deflect each drop a different amount from the nozzle axis 3, and thereby to generate a wide "fan" of printed drops, as shown at 9*a*-9*n* in FIG. 3 on the substrate 4. In the prior art arrangement illustrated in FIG. 3, the uncharged free-fall drops are the drops not to be printed and therefore received by the gutter 8, whereas the drops 5*a* to be printed are all charged drops which are deposited on the substrate 4 at various locations, as shown at 9*a*-9*n*, according to the multi-level charge received by the respective drop. In FIG. 3, the charged drop 5*a* to be deflected the longest distance is indicated by printed dot 9*n* in FIG. 3.

Further details of the construction and operation of such known ink jet printers as illustrated in FIGS. 1-3 are set forth in the above-cited prior patents, the disclosures of which are incorporated herein by reference.

DESCRIPTION OF PREFERRED EMBODIMENTS OF THE INVENTION

FIGS. 4-14 illustrate ink jet printers constructed in accordance with various aspects of the present invention. In order to simplify the description and also to facilitate understanding of the present invention, those parts of the ink jet printer which correspond to the prior art printer as described above with respect to FIGS. 1-3 are identified generally by the same reference numerals.

FIG. 4 illustrates a multi-level deflection arrangement wherein the charging plates 6 apply a multi-level charge to the drops 5 exiting from the nozzle 2 such that the deflecting plates 7 deflect the drops 5*a* to be received on the substrate 4 to any one of a plurality of locations thereon, as shown by print dots 9*a*-9*n*, according to the charge applied to the respective drops, whereas the drops 5*b* not to reach the substrate 4 are caught in the gutter 8.

In the arrangement illustrated in FIG. 4, however, the drops 5*a* to be deposited on the substrate 4 are either uncharged, or charged to a selected one of a plurality of charge levels of one polarity; whereas the drops 5*b* not to be printed on the substrate 4 are charged to a level of the opposite sign. Thus, as shown in FIG. 4, the substrate 4 will receive, as printed dots, the un-charged (free-fall) drops to produce the printed dot 9*a* along the nozzle axis 3, and also the selected one of the charged drops, charged to a selected level of one polarity, which drops will be deposited on the substrate 4 to produce the printed dots 9*b*-9*n* according to the selected charge. On the other hand, the drops which are charged with the opposite sign are deflected in the opposite direction from the nozzle axis 3 towards the gutter 8 so as to be caught by the gutter before reaching the substrate 4, as shown by drops 5*b* in FIG. 4.

The arrangement illustrated in FIG. 4 has a number of advantages. One important advantage is that it enables a wider fan of printing drops to be produced without increasing the charge to be applied to the drop to experience the largest deflection. Thus, as shown in FIG. 4, the outside printed dot 9*n* is significantly closer to the nozzle axis 3 than the outside printed dot 9*n* in FIG. 3.

A further important advantage is that the arrangement illustrated in FIG. 4 enables the uncharged or free-fall drops to be used for calibration purposes since those drops do reach the substrate 4, as indicated by printed dot 9*a* in FIG. 4; whereas the uncharged drops in the prior art arrangement illustrated in FIG. 3 were received by the gutter 8 and therefore could not be effectively used for calibration purposes. The description below illustrates various ways in which the uncharged free-fall drops may be used for calibration purposes.

FIG. 5 illustrates an arrangement, similar to that of FIG. 4 and therefore also uses the same reference numerals for identifying corresponding parts. The basic difference in the arrangement illustrated in FIG. 5 over that illustrated in FIG. 4 is that, whereas in FIG. 4 the charges of each liquid ink drop of the opposite polarity (i.e., directed to the gutter 8) is at only one voltage level, in FIG. 5 the charges of the opposite polarity can also be of a plurality of voltage levels. For example, the drops 5*b* to be directed to the gutter 8 and not to be deposited on the substrate 4 may be charged to a relatively high level of any polarity, whereas the drops 5*a* to be deposited on the substrate 4 to print the dots 9*a*-9*n* may be charged to lower levels of the same polarity, uncharged, or charged to a selected level of the opposite polarity.

Thus, in the example illustrated in FIG. 5, all the non-printing drops 5*b* to be received by the gutter 8 are negatively charged to the highest level; the printing drops 5*a* to print the dots 9*a*-9*c* on the substrate 4 are negatively charged at successively lower levels; the drops 5*a* to form the dots 9*d* in alignment with the nozzle axis are uncharged so as to be free-falling; whereas the remaining drops 5*a* to produce the printed dots 9*e*-9*n* are positively charged to successively higher charge levels.

The arrangement illustrated in FIG. 5 thus also enables a relatively wide "fan" of dots to be produced by each nozzle without increasing the charge levels, and further enables the free-fall drops to be used for calibration purposes.

FIG. 6 illustrates an arrangement similar to that of FIG. 5, and therefore utilizes the same reference numerals for identifying corresponding parts. However, whereas in FIG. 5 the deflecting plates are parallel to each other and to the nozzle axis 3, in FIG. 6 the deflecting plates 7 include a section 7*a* on the end facing the charging plates 6 which are parallel to each other and to the nozzle axis, but further include a diverging section 7*b* on the end facing the substrate 4 which diverge in the direction of the substrate. Such an arrangement also enables a relatively wide fan of printed dots to be produced without unduly increasing the charging voltages required for this purpose.

As indicated earlier, an important advantage in the arrangements illustrated in FIGS. 4-6 is that such arrangements enable the uncharged or free-fall drops to be used to calibrate the apparatus as often as may be required in order to maintain the efficient operation of the apparatus.

FIG. 7 illustrates one manner of utilizing the uncharged free-fall liquid ink drops for this purpose. Again, in order to simplify the description while facilitating understanding, FIG. 7 utilizes the same reference numerals to identify parts corresponding to those described above.

The calibration technique illustrated in FIG. 7 utilizes a stroboscopic illumination unit, generally designated 10, and one or more cameras, generally designated 11, for capturing, in free flight, the uncharged free-fall drops to be printed, shown at 5*a*, i.e., those not charged by the charging plates 6 or deflected by the deflecting plates 7. The stroboscopic illumination unit 10 may be an LED (light emitting diode) unit having the ability to strobe at a frequency equal to the frequency of the generation of the ink drops 5; and the camera unit 11 preferably incorporates a CCD camera and an imaging lens to display the drops viewed by the camera in a display unit 12, and/or to provide an input to a frame grabber for digital image processing in a computer. For example, the liquid ink drops 5 may be generated at a rate of 30 kHz, and the illumination unit 10 may be strobed with the same frequency, to enable the camera unit 11 to capture the drops in free flight and to display them in the display unit 12, and/or to process data regarding them in a computer.

Figure 8:
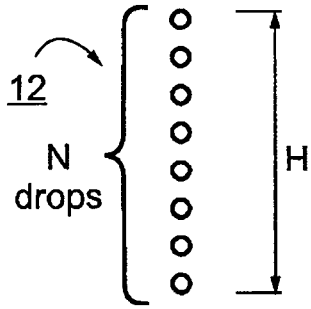

FIG. 8 illustrates the image captured by the camera 11 when the illumination unit 10 is strobed at the frequency of generation of the liquid ink drops by the nozzle 2. Analysis of the image illustrated in FIG. 8 enables the velocity of the drops in the captured stream to be calculated according to the following equation:

$$V=H/(N-1)\,(SF)$$

wherein: V is the velocity of the free-fall stream of drops 5*a*; N is the number of drops displayed; H is the distance between the first and last drops (calibrated by reference to an external element or derived from reference elements in the image); and SF is the strobe frequency of operation of the illumination unit 10.

Figure 9:
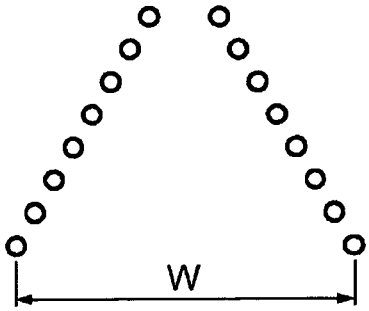

An image of a bi-level stream of charged drops having pre-determined charging drive values may be captured. This may be done by dividing the stream of ink drops from the nozzle into two streams by using charging pulses of two charging levels and appropriately phasing the timing of the charging pulses. FIG. 9 illustrates the resulting display of the two streams. In FIG. 9, the separation (W) between the two streams of drops at a given plane has a direct correlation to the jet or drop speed measured in accordance with the above equation, and may therefore be used for providing a correction factor for correcting velocity errors and for selecting the proper sequence of charging voltages to be used during printing.

As indicated earlier, printing inaccuracies resulting from velocity errors produced by many different factors may be corrected by changing the charging voltages applied to the ink drops since the amount of deflection to be experienced by the drops before reaching the substrate depends both on the ink jet speed and the charging voltage applied to the charging plates.

As also indicated earlier, for accurate printing it is necessary that the charging pulses be applied to the charging plates 6 at the right phase relative to the drop break-off time, i.e., that the charging pulses be in an in-phase condition with respect to the drop break-off time. The stroboscopic arrangement illustrated in FIG. 7 may also be used for calibrating the apparatus with respect to this phase relationship.

Figure 10:
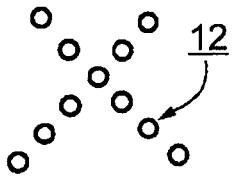
Figure 11:
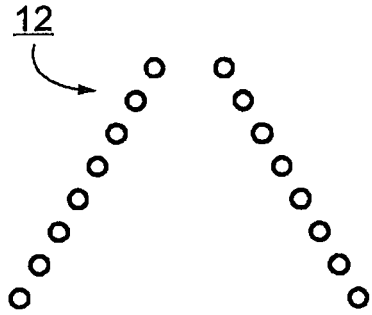

For this purpose, a bi-level stream of charged drops is generated as illustrated in FIG. 9 and described above, and the time delay between the drop formation rate and the charging rate (i.e. the phase relationship) is changed slowly. Video frames corresponding to the continuously changing phases are captured by the video camera 11. FIG. 10 illustrates the display 12 when the charges are not in the required in-phase relation with respect to the drop break-off times; whereas FIG. 11 illustrates the display when the charging pulses are in the desired in-phase condition with respect to the drop break-off timing.

FIG. 7*a* illustrates a stroboscopic arrangement which may be used for observing and controlling the shape of the ink drops formed in the nozzle 2, particularly to avoid or minimize the formation of satellites. As described earlier, such satellites can result in an early electrical breakdown or in a malfunction of the printer since the mass of the satellites is substantially smaller than that of the ink drop itself, and therefore experience stronger acceleration inside the deflection field such that they may hit the deflection electrodes rather than the substrate (or the gutter). Thus, the arrangement illustrated in FIG. 7*a,* includes the stroboscopic illumination unit 10*a* and the camera unit 11*a* aligned with the nozzle 2 immediately downstream of the nozzle 2. This enables the shape of the ink drops to be observed on the fly immediately before and after break-up. The jet acoustic excitation, i.e. the perturbation produced by the piezoelectric device to form the drops, may be varied, and its effect on the drop formation may be observed in real-time as the excitation is changed. This enables the changes in the shape of the formed ink drops to be observed as the excitation is changed.

Typically, at lower excitations, the drops before break-up are joined by filaments of decreasing thickness in the downstream direction. Upon increasing the excitation, there is a tendency to produce satellites; and upon further increasing the excitation, a condition is reached in which the filament joining two successive drops before break-up breaks from the rear drop and merges with the forward drop forming a forward tail. A further increase in excitation may lead, in certain cases, to a non-uniform behavior of the drop formation, including the return to the unwanted conditions of satellite formation or rear-merging formations.

By thus monitoring, by visually observing, the drop formations in a real-time manner as the amplitudes of the acoustic excitations are varied, it is possible to calibrate the apparatus so as to completely eliminate or minimize the formation of satellites.

FIG. 12 is a block diagram illustrating one manner in which an ink jet printer may be operated and calibrated in accordance with the present invention as described above. The ink jet printer illustrated in FIG. 12 includes a printer head 20 mounting a line of nozzles 21 each discharging a stream of liquid ink drops towards a substrate 22 for deposition thereon according to a desired pattern to be printed. As briefly described above, and as more particularly described in the above-cited patents incorporated herein by reference, the printer head 20 includes a reservoir of liquid ink and a piezoelectric perturbation device for producing a stream of liquid ink drops originally along the axis of the respective nozzle, but selectively charged by charging plates 23 and deflected by deflecting plates 24 according to the desired pattern to be printed on the substrate.

As shown in FIG. 12, the overall operation of the apparatus is controlled by a system controller 25 according to the data inputted via an input device 26. The system controller 25 controls the charges applied to the charging plates 23 by means of a charger circuit 27 and a phase shifter circuit 28. Controller 25 also controls the charges to be applied to the deflector plates 24 via a deflector circuit 29. As further shown in FIG. 12, controller 25 further controls the printer mechanical drive 30, the printer electrical drive (e.g. the perturbation piezoelectric device) 31, the substrate drive 32, and a display 33.

FIG. 12 also illustrates the additional components for controlling the operation of the apparatus as described above, and particularly for calibrating it as described with respect to FIGS. 7-11. Thus, as shown in FIG. 12, for calibrating the apparatus, the system is provided with a stroboscopic illumination unit, generally designated 40, incorporating unit 10 in FIG. 7 and unit 10*a* in FIG. 7*a*, and with a video imaging unit, generally designated 41, incorporating unit 11 in FIG. 7 and unit 11*a* in FIG. 7*a*. The illumination unit 40 may be an LED stroboscopic device having the ability to strobe at a frequency equal to the drop generation frequency; and the video imaging unit 41 may include one or more CCD cameras and one or more imaging optics capable of capturing the ink drops "on the fly" either upstream (for drop formation calibration) or downstream (for speed, alignment and phase calibration). Video imaging unit 41 displays the ink drops in a display 42, and/or digitally stores them and processes them with a frame grabber of a computer, to enable automatic calibration of the apparatus as described above with respect to FIGS. 7-11. The LED stroboscopic device 40 includes a drive, shown at 43, also controlled by the system controller 25.

As described earlier, an important condition for proper operation of the printer is the speed of the free-fall stream of ink drops, which can be observed and the velocity computed in real-time. The computation of the ink drop velocity may be done manually, e.g. by comparison with reference tables or diagrams, or can be computed automatically. FIG. 12 therefore illustrates the inclusion of a computer 44 for making this computation automatically.

As further indicated above, printing errors resulting from variations in the drop formation within the acceptable forward tail condition, and drop velocity, can be corrected by adjusting the charging voltages applied to the charging plates 23 since the amount of deflection experienced by the ink drops depends not only on the drop velocity, but also on the voltage on the plates which determine the charging of the drops. Thus, the system controller 25 could include a manual (or automatic) input device 45 for controlling the charger circuit 27 to compensate for drop velocity errors or incorrect drop charging.

Printing errors resulting from incorrect phasing between the charging pulses applied to the ink drops at the nozzles 21 and the ink drop break-off times, can be corrected by an input 46 to the system controller 25 controlling the phase shifter circuit 28.

The formation of satellites in the ink drops can be suppressed by an input 47 to the system controller 25 for controlling the piezoelectric perturbation drive 31. As described above, the perturbation device within the printer head 20 can be controlled so as to produce an optimum shape of the ink drops and with no, or substantially no, satellites.

FIG. 13 illustrates an apparatus, similar to that of FIG. 12, but provided with a second sensor device, namely a second camera therein designated 50, having a sensor axis 50*a* at a predetermined angle to the axis 41*a* of camera 41. The outputs of the two cameras 41, 50 are fed to the system controller 25 which processes these outputs, together with the predetermined angle between the axes of the two cameras, to compute any deviation of the stream of ink drops from its respective nozzle axis (a) in the direction parallel to the row of nozzles 21 (X-axis offset), and (b) in the direction perpendicular to the row of nozzles (Y-axis offset). System controller 25 corrects the computed X-offset for a particular nozzle by controlling the charger circuit 27 to adjust the charging voltage applied to the charging plates 23 for the respective nozzle. System controller 25 corrects the computed Y-axis offset for a particular nozzle by adjusting the timing of the input data from the input device 26 applied by the system controller 25 to the respective nozzle.

In all other respects, the apparatus illustrated in FIG. 13 operates in the same manner as described above with respect to FIG. 12, and therefore the corresponding parts are identified with the same reference numerals to facilitate understanding.

FIG. 14 illustrates one configuration for measuring the X-axis offset and Y-axis offset from the output of the two cameras 41, 50, where the angle "α-" is the known predetermined angle between their respective axes. For example, angle "α-" could be 45°. As indicated in FIG. 14, there are geometrical parameters defining the configuration These include the separation (dX, dY) between the imaging device 61 and the imaging device 62, the angle (α) between the imaging device 61 and the imaging device 62, the focal lengths f1 and f2 of the imaging devices 61 and 62 respectively, and the positions ($f1_x$, $f1_y$) and ($f2_x$, $f2_y$) of the lenses of the imaging devices 61 and 62 respectively.

As indicated in FIG. 14, a jet at position (x,y) in the object plane will be imaged at ($x_i$,0) by the imaging device 61 and at (x1+dX, dY) by the imaging device 62, whereas a jet at position (xn,yn) in the object plane will be imaged at (S1x, S1y) by the imaging device 61 and at (S2x, S2y) by the imaging device 62.

During calibration, several frames are captured by imaging devices 61 and 62 at successive jet positions ($x_i$, $y_i$). These frames are digitized through a frame grabber. From the values of (Si1x, Si1y) and (Si2x, Si2y), the values of x offset and y offset for each jet can be derived.

The object is to measure the geometrical position of the streams of jets with high accuracy by using a stroboscopic arrangement of imaging devices.

In FIG. 14 there are seven geometrical parameters which can not be accurately set or measured, while at the same time their values are required in order to perform the required measurement with the required accuracy. The seven parameters are:

Dx=the separation in the x axis between the center of imaging device 61 and the center of imaging device 62;

Dy=the separation in the y axis between the center of imaging device 61 and the center of imaging device 62;

α=the angle between imaging device 61 and imaging device 62;

f1=the focal length of the imaging device 61;

f2=the focal length of imaging device 62;

c1=the center of the image plane on the CCD in imaging device 61;

c2=the center of the image plane on the CCD in imaging device 62.

The method employs multiple measurement of each jet, while each measurement is performed at a slightly different position of the cameras carriage relative to the line of jets. The movement of the carriage is accurately measured by an encoder. The movement of the carriage is adjusted to be predominantly parallel to the row of nozzles (or in an alternative language—to the plane defined by the jets).

For each measurement position, a certain number of jets are measured (for instance three jets) simultaneously by the two cameras 41, 50. According to the laws of geometrical optics, a set of equations will be derived for each camera for each measurement position. Therefore, if "n" measurements are performed, a set of 2n equations will be obtained which have the general form:

$$y_n A_1 = x_n B_1 + C_1$$

$$y_n A_2 = x_n B_2 + C_2$$

Where $A_{1,2}$, $B_{1,2}$ and $C_{1,2}$ represent equations between the geometrical parameters and the measured quantities (x,S1x, S1y,S2x,S2y).

The solution for this set of equations, for each value of n, is:

$$Xn = (C2A1 - C1A2)/B1A2 - B2A1)$$

$$Yn = (XnB2 + C2)/A2$$

A numerical solution is possible for the above equations once the values of the geometrical parameters are known. In the method employed, a solution was found which overcomes the necessity to measure the geometrical parameters, but rather computes them from the set of equations and measurements by employing the following steps:

i) a set of initial parameters is defined;

ii) using this initial set of parameters, the positions of each jet is computed. For each jet there will be several solutions since each jet is measured several times at different cameras positions (according to the movement of the carriage);

iii) the quadratic position error for each jet is computed from the solutions in ii) above;

iv) the initial geometrical parameters are changed until the minimum quadratic errors for all jets are obtained. This optimization process is performed in successive steps where initially only a reduced number of geometrical parameters is varied—for instance, if four parameters out of the seven possible parameters are varied there will be $3^7$ different sets of parameters. Subsequently, only a limited number of the possible different sets will be chosen which give the minimum error (for instance 10 sets); and around this reduced group of preferred sets slightly different sets will be analyzed;

v) the final result of the algorithm and computation method provides the optimal set of geometrical parameters to be used for computing the positions of the jets and from the measurements performed, provides the x and y position for each jet.

While the invention has been described with respect to several preferred embodiments, it will be appreciated that these are set forth merely for purposes of example, and that many other variations, modifications and applications of the invention may be made.

What is claimed is:

1. A method of printing a desired pattern on a substrate, comprising:

discharging a continuous stream of liquid ink drops from a nozzle along the nozzle axis towards the substrate;

selectively charging said liquid ink drops with multilevel charges for selectively deflecting them different amounts with respect to the nozzle axis to thereby direct some of the liquid ink drops to different locations on the substrate for printing said desired pattern thereon, while other liquid ink drops not to be printed are intercepted by a gutter before reaching the substrate;

illuminating the stream of liquid ink drops discharged from the nozzle with stroboscopic light at the frequency of the drop formation;

optically sensing and displaying an image of the illuminated stream of liquid drops and the distance between the first and last drops;

and calculating the velocity of the liquid drops according to the image displayed.

2. The method according to claim 1, wherein the illuminated stream of drops is sensed by a camera having an imaging lens.

3. The method according to claim 2, wherein errors in the ink velocity are determined by comparing the optically-sensed stream of drops with a reference and are compensated for by modifying the level of the charges applied to the drops.

4. The method according to claim 1, wherein said stream of liquid ink drops imaged and sensed is a stream of uncharged liquid ink drops.

5. The method according to claim 1, wherein a plurality of said continuous streams of drops are discharged from a plurality of nozzles arranged in at least one row, and wherein said drops of each of said streams are selectively charged by input data according to the pattern desired to be printed; the liquid ink drops of each of said streams being sensed by at least two optical sensor devices having sensor axes at a predetermined angle to each other; said optical sensor devices producing outputs which are processed, together with said predetermined angle, to compute deviations of the respective streams of ink drops from the respective nozzles (a) in the direction parallel to said row of nozzles (X-axis offset), and (b) in the direction perpendicular to said row of nozzles (Y-axis offset).

6. The method according to claim 5, wherein each of said optical sensor devices includes a camera having an imaging lens.

7. The method according to claim 5, wherein said computed X-axis offset for a particular nozzle is corrected by adjusting the charging voltages for the respective nozzle.

8. The method according to claim 5, wherein said computed Y-axis offset for a particular nozzle is corrected by adjusting the timing of said input data to the respective nozzle.

9. A method of printing a desired pattern on a substrate, comprising:

discharging a continuous stream of liquid ink drops from a nozzle along the nozzle axis towards the substrate;

and selectively charging said liquid ink drops with multilevel charges for selectively deflecting them different amounts with respect to the nozzle axis to thereby direct some of the liquid ink drops to different locations on the substrate for printing said desired pattern thereon, while other liquid ink drops not to be printed are intercepted by a gutter before reaching the substrate;

wherein the stream of ink drops produced from the nozzle is divided into two streams by charging pulses of two charging levels and of appropriate phases; and wherein the two streams of ink drops are optically sensed by an imaging system for determining, and for correcting; velocity errors, and/or charge phasing errors between the respective charging pulses and the physical drop formation timing in the stream exiting from the nozzle.

10. The method according to claim 9, wherein the charge phasing errors are detected and are corrected by correcting the time delay between the respective charging pulse and the physical drop separation in the stream exiting from the nozzle.

11. The method according to claim 9, wherein velocity errors are detected and are corrected by modifying the level of the charge applied to the ink drops.

12. The method according to claim 9, wherein said two streams of ink drops are optically sensed on the fly by illuminating them with stroboscopic light at the frequency of the drop formation.

13. A method of printing a desired pattern on a substrate, comprising:

forming a continuous stream of liquid ink drops by an acoustical excitation device in a nozzle;

discharging the stream of drops from nozzle along the nozzle axis towards the substrate;

and selectively charging said liquid ink drops with multilevel charges for selectively deflecting them different amounts with respect to the nozzle axis to thereby direct some of the liquid ink drops to different locations on the substrate for printing said desired pattern thereon, while other liquid ink drops not to be printed are intercepted by a gutter before reaching the substrate;

wherein the forming of the liquid ink drops is monitored on the fly by illuminating the stream of drops with stroboscopic light at the frequency of the drop formation, an image of a plurality of liquid drops in the illuminated streams is optically sensed and displayed; the distance between the first and last drops in the displayed image is observed to determine the velocity of the individual drops in a manner which tends to cancel noise and drop break-off is controlled by controlling said acoustical excitation device to avoid satellite formations in the displayed image of drops.

14. A method of printing a desired pattern on a substrate, comprising:

discharging a plurality of continuous streams of liquid ink drops from a plurality of nozzles having nozzle axes arranged in at least one row;

selectively charging said liquid ink drops by input data, according to the pattern desired to be printed, with multilevel charges for selectively deflecting said liquid ink drops given amounts with respect to their respective nozzle axes to thereby direct some of the liquid ink drops to different locations on the substrate for printing said desired pattern thereon, while other liquid ink drops not to be printed are intercepted by a gutter before reaching the substrate;

utilizing at least two sensor devices for sensing the liquid ink drops of each of said streams, said sensor devices having sensor axes at a predetermined angle to each other;

and processing outputs of said sensor devices, including said predetermined angle of their sensor axes, to compute deviations of the respective stream of ink drops from the respective nozzle axis (a) in the direction parallel to said row of nozzles (X-axis offset), and (b) in the direction perpendicular to said row of nozzles (Y-axis offset).

15. The method according to claim 14, wherein said sensor devices are optical sensors, and said streams of ink drops are illuminated with stroboscopic light at the same frequency as the drop formation.

16. The method according to claim 15, wherein each of said optical sensors includes a camera having an imaging lens.

17. The method according to claim 14, wherein said computed X-axis offset for a particular nozzle is corrected by adjusting the charging voltages for the respective nozzle.

18. The method according to claim 14, wherein said computed Y-axis offset for a particular nozzle is corrected by adjusting the timing of said input data to the respective nozzle.

19. Printing apparatus for printing a desired pattern on a substrate, comprising:

a plurality of nozzles for forming and discharging continuous streams of liquid ink drops along the respective nozzle axis towards the substrate, said nozzles being arranged in at least one row;

charging plates for each nozzle for selectively charging the liquid ink drops of the respective nozzle with input data according to the pattern desired to be printed;

deflecting plates for each nozzle for selectively deflecting the liquid ink drops different amounts with respect to the respective nozzle axis for printing on a substrate the desired pattern;

a gutter for intercepting, before reaching the substrate, the liquid ink drops not to be printed;

at least two sensor devices for sensing the liquid ink drops in each of said continuous streams, said sensor devices having sensor axes at a predetermined angle to each other; and a control system for controlling said charging plates and said deflecting plates, said control system processing outputs from said sensor devices, computing deviations of the respective stream of ink drops from the respective nozzle axis (a) in the direction parallel to said row of nozzles (X-axis offset), and (b) in the direction perpendicular to said row of nozzles (Y-axis offset); and correcting the pattern printed by the respective nozzle in accordance with the computed deviations.

20. The apparatus according to claim 19, wherein said sensor devices are optical sensors, and said streams of ink drops are illuminated with stroboscopic light at the same frequency as the drop formation.

21. )The printing apparatus according to claim 20, wherein each of said optical sensors includes a camera having an imaging lens.

22. The printing apparatus according to claim 19, wherein said controller corrects said X-axis offset for a particular nozzle by adjusting the charging voltages applied to the respective nozzle.

23. The apparatus according to claim 19, wherein said controller corrects said Y-axis offset by adjusting the timing of said input data to the respective nozzle.

* * * * *